US012723507B2

(12) United States Patent
Alali et al.

(10) Patent No.: US 12,723,507 B2
(45) Date of Patent: Sep. 1, 2026

(54) MONITORING FLUID STORED IN A SUBTERRANEAN FORMATION

(71) Applicant: Saudi Arabian Oil Company, Dhahran (SA)

(72) Inventors: Abdulmohsen Alali, Dammam (SA); Saleh Alnasser, Safwa (SA); Thierry-Laurent Dominique Tonellot, Assas (FR)

(73) Assignee: Saudi Arabian Oil Company, Dhahran (SA)

( * ) Notice: Subject to any disclaimer, the term of this patent is extended or adjusted under 35 U.S.C. 154(b) by 416 days.

(21) Appl. No.: 18/402,249

(22) Filed: Jan. 2, 2024

(65) Prior Publication Data

US 2025/0215787 A1 Jul. 3, 2025

(51) Int. Cl.
*E21B 47/107* (2012.01)

(52) U.S. Cl.
CPC ..... *E21B 47/107* (2020.05)

(58) Field of Classification Search
CPC ..... E21B 47/107
See application file for complete search history.

(56) References Cited

U.S. PATENT DOCUMENTS

| | | | |
|---|---|---|---|
| 4,817,059 A | 3/1989 | Hornby et al. | |
| 5,999,389 A | 12/1999 | Luebke et al. | |
| 6,956,790 B2 | 10/2005 | Haldorsen | |
| 7,492,664 B2 | 2/2009 | Tang et al. | |
| 8,902,702 B2 | 12/2014 | Hirabayashi et al. | |
| 9,239,396 B2 | 1/2016 | Thompson et al. | |
| 11,016,212 B2 | 5/2021 | Sun et al. | |
| 2011/0066380 A1 | 3/2011 | Hager et al. | |
| 2025/0215787 A1* | 7/2025 | Alali | E21B 47/107 |

FOREIGN PATENT DOCUMENTS

| | | |
|---|---|---|
| WO | WO2010109340 | 9/2010 |
| WO | WO2016160964 | 10/2016 |

OTHER PUBLICATIONS

Alqatari et al., "Near-Borehole Imaging Using Full-Waveform Sonic Data," Society of Petroleum Engineers, Dec. 2021, 9 pages.

(Continued)

*Primary Examiner* — Daniel Pihulic
(74) *Attorney, Agent, or Firm* — Fish & Richardson P.C.

(57) ABSTRACT

A fluid monitoring system includes at least one injection wellbore formed from a terranean surface into a subterranean formation; a fluid injection assembly configured to circulate a fluid through the at least one injection wellbore and into the subterranean formation; at least one monitor wellbore formed from the terranean surface into or near the subterranean formation, where the at least one monitor wellbore is separated from the at least one injection wellbore by the subterranean formation; at least one acoustic energy source positioned in the at least one monitor wellbore and configured to emit acoustic energy from the at least one monitor wellbore into the subterranean formation; and at least one acoustic energy receiver positioned in the at least one monitor wellbore and configured to receive acoustic energy reflected from the fluid circulated into the subterranean formation to the at least one acoustic energy receiver.

32 Claims, 4 Drawing Sheets

(56) References Cited

OTHER PUBLICATIONS

Coates et al., "Single-well Sonic Imaging: High-Definition Reservoir Cross-sections from Horizontal Wells," SPE/CIM International Conference on Horizontal Well Technology, Nov. 2000, 10 pages.
Fortin et al., "Reflection Imaging around a Well with the EVA Full-Waveform Tool," The Log Analyst, May 1991, 32(03): 271-278.
Hornby et al., "Reflection Sonic Imaging of Complex Near-Borehole Structure in Slow Formations," SEG International Exposition and Annual Meeting, Oct. 2018, 5 pages.
Li et al., "Azimuth Ambiguity Elimination for Borehole Imaging using 3D Borehole RTM Scheme," CREWES Research Report, 2015, 27(1), 12 pages.
Lumley et al., "4D Seismic Monitoring of $CO_2$ Sequestration," The Leading Edge, Feb. 2010, 29(2): 150-155.
Nguyen et al., "Excitation Amplitude Imaging Condition for Prestack Reverse-Time Migration," Geophysics, Jan. 2013, 78(1): 37-46.
Schmitt et al., "Wellbore Far-Field Imaging for High Resolution Reservoir Characterization," International Petroleum Technology Conference, Jan. 2020, 12 pages.
Zhang et al., "Cross-well Seismic Waveform Tomography for Monitoring $CO_2$ Injection: A Case Study from the Ketzin Site, Germany," Geophysical Journal International, Apr. 2012, 189(1): 629-646.

* cited by examiner

MONITORING FLUID STORED IN A SUBTERRANEAN FORMATION

TECHNICAL FIELD

This disclosure relates to systems and methods for monitoring a fluid stored in a subterranean formation.

BACKGROUND

Fluid storage in geological formation is a process of injecting fluid into a subsurface formation, such as depleted oil and gas reservoirs, saline aquifers and coal beds. It can be done to store gas for future use and help reduce emission by displacing the use of other fuels. It can play an important role in the world's ambition to reduce emission, meet energy requirements and provide flexibility. A safety challenge for fluid storage is to ensure there is no risk of fluid leaking into the surface. Surface seismic monitoring can be used to ensure safe and successful operation. Factors such as near-surface complexity, noise and attenuation can make it challenging to track the movement of the fluid accumulation and assess the impact of the injection.

SUMMARY

In an example implementation, a fluid monitoring system includes at least one injection wellbore formed from a terranean surface into a subterranean formation; a fluid injection assembly configured to circulate a fluid through the at least one injection wellbore and into the subterranean formation; at least one monitor wellbore formed from the terranean surface into or near the subterranean formation, where the at least one monitor wellbore is separated from the at least one injection wellbore by the subterranean formation; at least one acoustic energy source positioned in the at least one monitor wellbore and configured to emit acoustic energy from the at least one monitor wellbore into the subterranean formation; and at least one acoustic energy receiver positioned in the at least one monitor wellbore and configured to receive acoustic energy reflected from the fluid circulated into the subterranean formation to the at least one acoustic energy receiver.

In an aspect combinable with the example implementation, the at least one injection wellbore includes a directional wellbore that includes a vertical wellbore portion, a curved wellbore portion, and a horizontal wellbore portion.

In another aspect combinable with any of the previous aspects, the at least one monitor wellbore includes a vertical wellbore.

In another aspect combinable with any of the previous aspects, the at least one monitor wellbore includes another directional wellbore that includes the vertical wellbore portion, another curved wellbore portion, and another horizontal wellbore portion.

In another aspect combinable with any of the previous aspects, wherein the at least one monitor wellbore includes a first monitor wellbore and a second monitor wellbore, each of the first and second monitor wellbores formed from the terranean surface into or near the subterranean formation.

In another aspect combinable with any of the previous aspects, the at least one acoustic energy source includes a first acoustic energy source positioned in the first monitor wellbore and a second acoustic waver energy source positioned in the second monitor wellbore; and the at least one acoustic energy receiver includes a first acoustic energy receiver positioned in the first monitor wellbore and a second acoustic energy receiver positioned in the first monitor wellbore.

In another aspect combinable with any of the previous aspects, the first monitor wellbore includes a first directional wellbore formed from the terranean surface into or near the subterranean formation, and the second monitor wellbore includes a second directional wellbore formed from the terranean surface into or near the subterranean formation.

In another aspect combinable with any of the previous aspects, the second directional wellbore has a total vertical depth greater than a total vertical depth of the first directional wellbore.

Another aspect combinable with any of the previous aspects further includes at least one downhole tool positionable in the at least one monitor wellbore and including the at least one acoustic energy source and the at least one acoustic energy receiver.

In another aspect combinable with any of the previous aspects, the at least one downhole tool includes a first downhole tool positionable in a first monitor wellbore of the at least one monitor wellbore, the first downhole tool including a first acoustic energy source and a first acoustic energy receiver; and a second downhole tool positionable in a second monitor wellbore of the at least one monitor wellbore, the second downhole tool including a second acoustic energy source and a second acoustic energy receiver.

In another aspect combinable with any of the previous aspects, the at least one downhole tool is configured to run into the at least one monitor wellbore on a downhole conveyance.

In another aspect combinable with any of the previous aspects, the downhole conveyance includes a wireline.

In another aspect combinable with any of the previous aspects, the at least one downhole tool includes a wireline sonic tool.

In another aspect combinable with any of the previous aspects, the at least one acoustic energy source positioned in the at least one monitor wellbore is configured to emit acoustic energy from the at least one monitor wellbore into the subterranean formation at a plurality of time instances during injection of the fluid from the at least one injection wellbore into the subterranean formation; and the at least one acoustic energy receiver positioned in the at least one monitor wellbore is configured to receive acoustic energy reflected from the fluid circulated into the subterranean formation to the at least one acoustic energy receiver at another plurality of time instances during injection of the fluid from the at least one injection wellbore into the subterranean formation.

Another aspect combinable with any of the previous aspects further includes a control system communicably coupled to the at least one acoustic energy receiver and configured to determine movement of the fluid in the subterranean formation based on the received acoustic energy reflected from the fluid circulated into the subterranean formation to the at least one acoustic energy receiver at the another plurality of time instances.

Another aspect combinable with any of the previous aspects further includes a control system communicably coupled to the at least one acoustic energy receiver and configured to determine movement of the fluid in the subterranean formation based on the received acoustic energy reflected from the fluid circulated into the subterranean formation to the at least one acoustic energy receiver.

In another example implementation, a method of monitoring a fluid in a subterranean formation includes operating a fluid injection assembly configured to circulate a fluid through at least one injection wellbore into a subterranean formation, the at least one injection wellbore formed from a terranean surface into the subterranean formation; operating at least one acoustic energy source positioned in at least one monitor wellbore to emit acoustic energy from the at least one monitor wellbore into the subterranean formation, the at least one monitor wellbore formed from the terranean surface into or near the subterranean formation separated from the at least one injection wellbore by the subterranean formation; and operating at least one acoustic energy receiver positioned in the at least one monitor wellbore to receive acoustic energy reflected from the fluid circulated into the subterranean formation.

In an aspect combinable with the example implementation, the at least one injection wellbore includes a directional wellbore that includes a vertical wellbore portion, a curved wellbore portion, and a horizontal wellbore portion.

In another aspect combinable with any of the previous aspects, the at least one monitor wellbore includes a vertical wellbore.

In another aspect combinable with any of the previous aspects, the at least one monitor wellbore includes another directional wellbore that includes the vertical wellbore portion, another curved wellbore portion, and another horizontal wellbore portion.

In another aspect combinable with any of the previous aspects, the at least one monitor wellbore includes a first monitor wellbore and a second monitor wellbore, each of the first and second monitor wellbores formed from the terranean surface into or near the subterranean formation.

In another aspect combinable with any of the previous aspects, operating at least one acoustic energy source includes operating a first acoustic energy source positioned in the first monitor wellbore and operating a second acoustic waver energy source positioned in the second monitor wellbore; and operating at least one acoustic energy receiver includes operating a first acoustic energy receiver positioned in the first monitor wellbore and operating a second acoustic energy receiver positioned in the first monitor wellbore.

In another aspect combinable with any of the previous aspects, the first monitor wellbore includes a first directional wellbore formed from the terranean surface into or near the subterranean formation, and the second monitor wellbore includes a second directional wellbore formed from the terranean surface into or near the subterranean formation.

In another aspect combinable with any of the previous aspects, the second directional wellbore has a total vertical depth greater than a total vertical depth of the first directional wellbore.

Another aspect combinable with any of the previous aspects further includes operating at least one downhole tool in the at least one monitor wellbore that includes the at least one acoustic energy source and the at least one acoustic energy receiver.

In another aspect combinable with any of the previous aspects, operating the at least one downhole tool includes operating a first downhole tool in a first monitor wellbore of the at least one monitor wellbore to activate a first acoustic energy source and a first acoustic energy receiver; and operating a second downhole tool in a second monitor wellbore of the at least one monitor wellbore to activate a second acoustic energy source and a second acoustic energy receiver.

Another aspect combinable with any of the previous aspects further includes running the at least one downhole tool into the at least one monitor wellbore on a downhole conveyance.

In another aspect combinable with any of the previous aspects, the downhole conveyance includes a wireline.

In another aspect combinable with any of the previous aspects, the at least one downhole tool includes a wireline sonic tool.

Another aspect combinable with any of the previous aspects further includes operating the at least one acoustic energy source positioned in the at least one monitor wellbore to emit acoustic energy from the at least one monitor wellbore into the subterranean formation at a plurality of time instances during injection of the fluid from the at least one injection wellbore into the subterranean formation; and operating the at least one acoustic energy receiver positioned in the at least one monitor wellbore to receive acoustic energy reflected from the fluid circulated into the subterranean formation to the at least one acoustic energy receiver at another plurality of time instances during injection of the fluid from the at least one injection wellbore into the subterranean formation.

Another aspect combinable with any of the previous aspects further includes determining movement of the fluid in the subterranean formation based on the received acoustic energy reflected from the fluid circulated into the subterranean formation to the at least one acoustic energy receiver at the another plurality of time instances.

Another aspect combinable with any of the previous aspects further includes determining movement of the fluid in the subterranean formation based on the received acoustic energy reflected from the fluid circulated into the subterranean formation to the at least one acoustic energy receiver.

Implementations of fluid monitoring systems and methods according to the present disclosure may also include one or more of the following features. For example, implementations according to the present disclosure can reduce a risk of a complex overburden masking a seismic image of a subterranean formation as a seismic wavefield is not scattered and attenuated far away from the target formation but instead is provided in or adjacent the formation. As another example, implementations according to the present disclosure can provide a higher resolution nature of sonic wavefield that can image bed resolution. Also, implementations according to the present disclosure can provide for a better overall noise to signal ratio in the vicinity of the target subterranean formation. Further, implementations according to the present disclosure can produce a higher resolution image superior to surface seismic due to the higher frequency content of data. This allows for more accurate and detailed imaging of a subterranean formation.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes example implementations of a fluid monitoring system that, for example, can monitor a fluid (such as a hydrocarbon fluid like gas, or a global warming fluid such as carbon dioxide) that is injected (for example, for the purpose of permanent or temporary storage) in a subterranean formation. In some aspects, a fluid monitoring system according to the present disclosure can include one or more acoustic (or seismic, or both) energy sources and one or more acoustic energy receivers. Example aspects of the system include the source(s) and receiver(s) positioned in one or more monitor wellbores that is formed within or near the subterranean formation in which one or more injection wellbores is formed to inject the fluid into the formation. During fluid injection into the formation, the one or more source(s) can be activated to provide acoustic energy into the subterranean formation. Reflected or transmitted acoustic energy from the formation is received or captured by the one or more receiver(s). The transmission and receipt of energy can be implemented one or multiple times during fluid injection. Received energy data can be used to calculate or determine, for example, time-lapse travel delays and amplitude variation of direction arrivals as well as reflection to track the fluid in the subterranean formation. Tracking of the fluid can be used to determine fluid movement as well as real or potential as well as ensuring no or little leakage of the fluid from the subterranean formation occurs.

Figure 1:
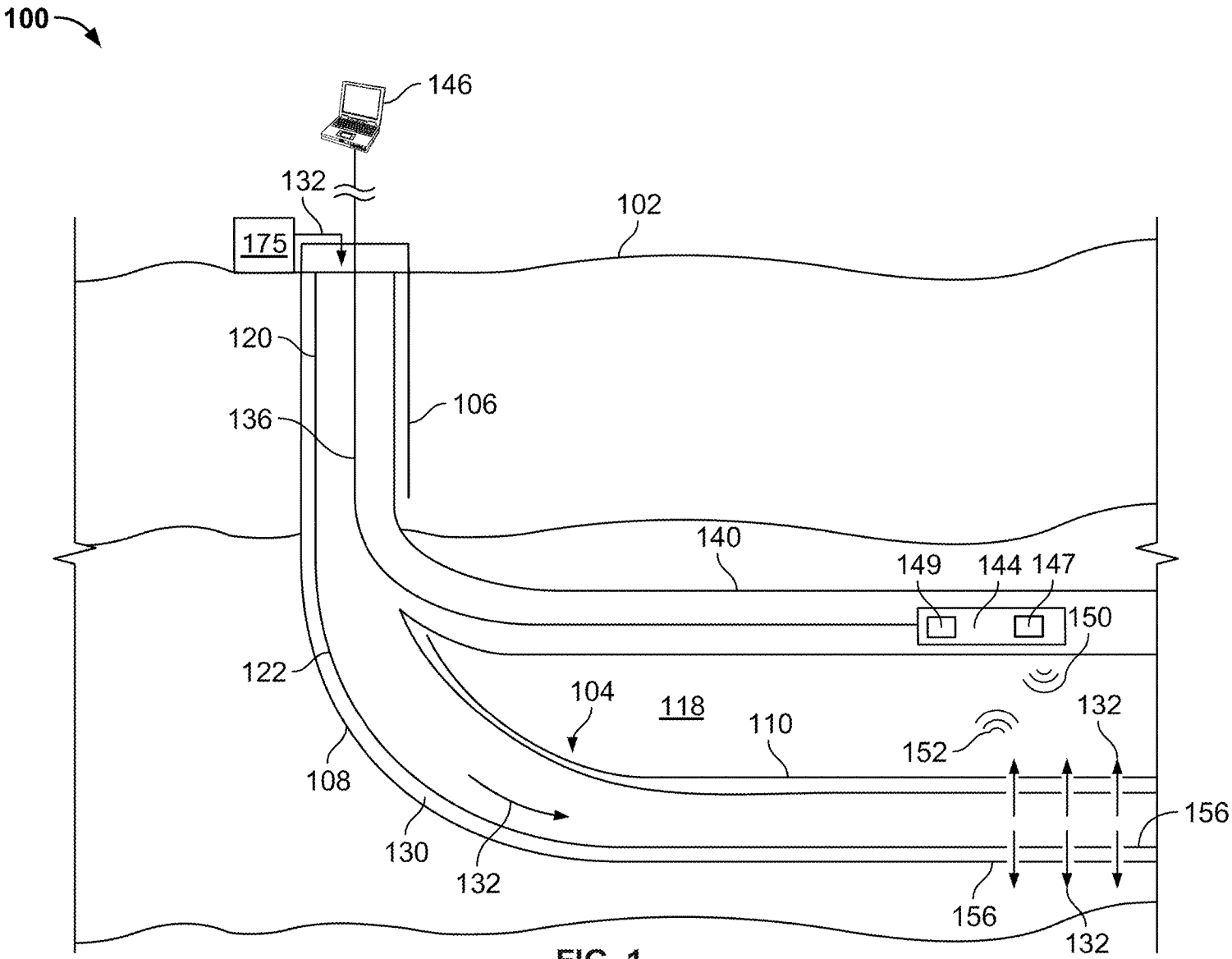
FIGS. 1-3 are schematic illustrations of example implementations of a fluid monitoring system according to the present disclosure.
Figure 2:
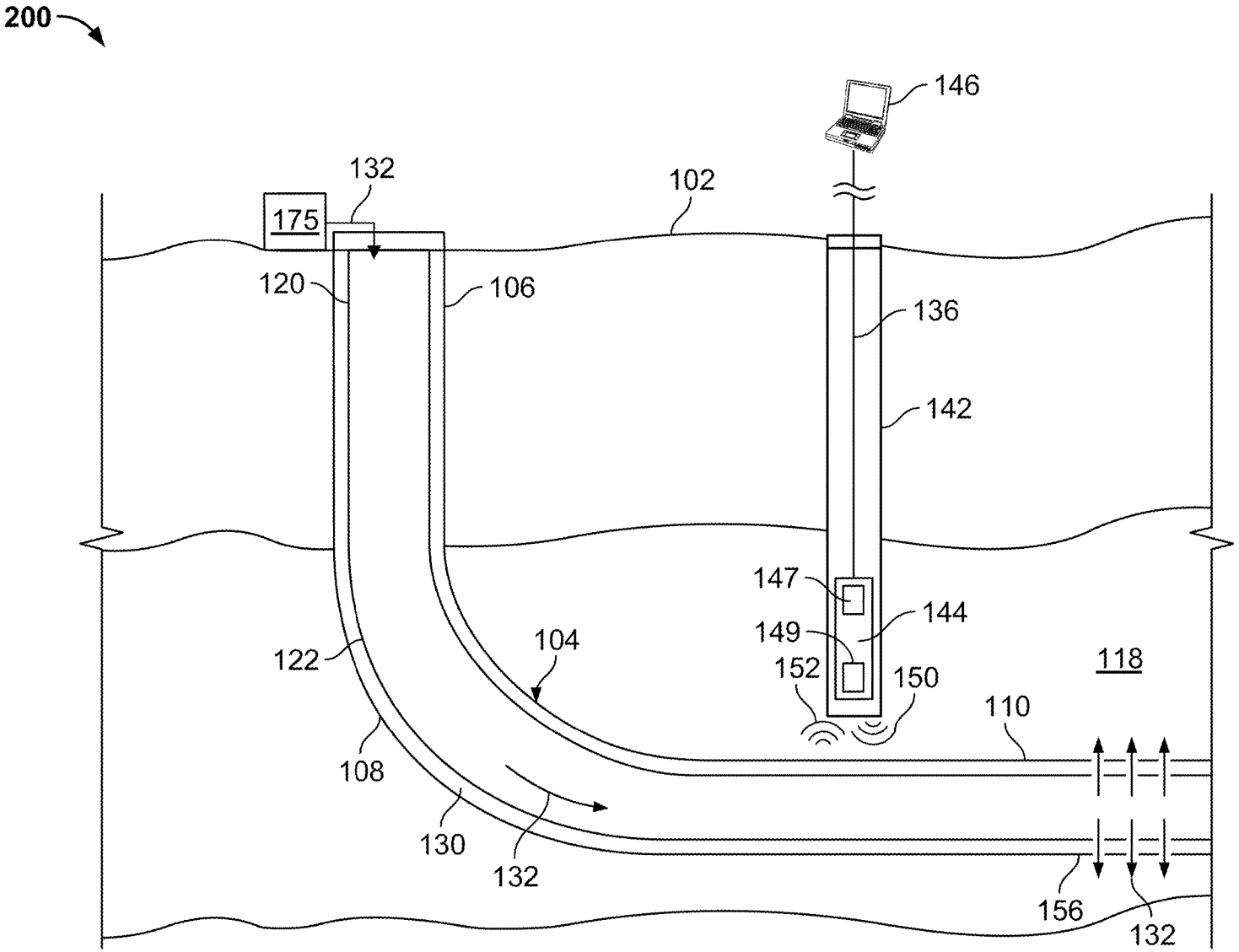
Figure 3:
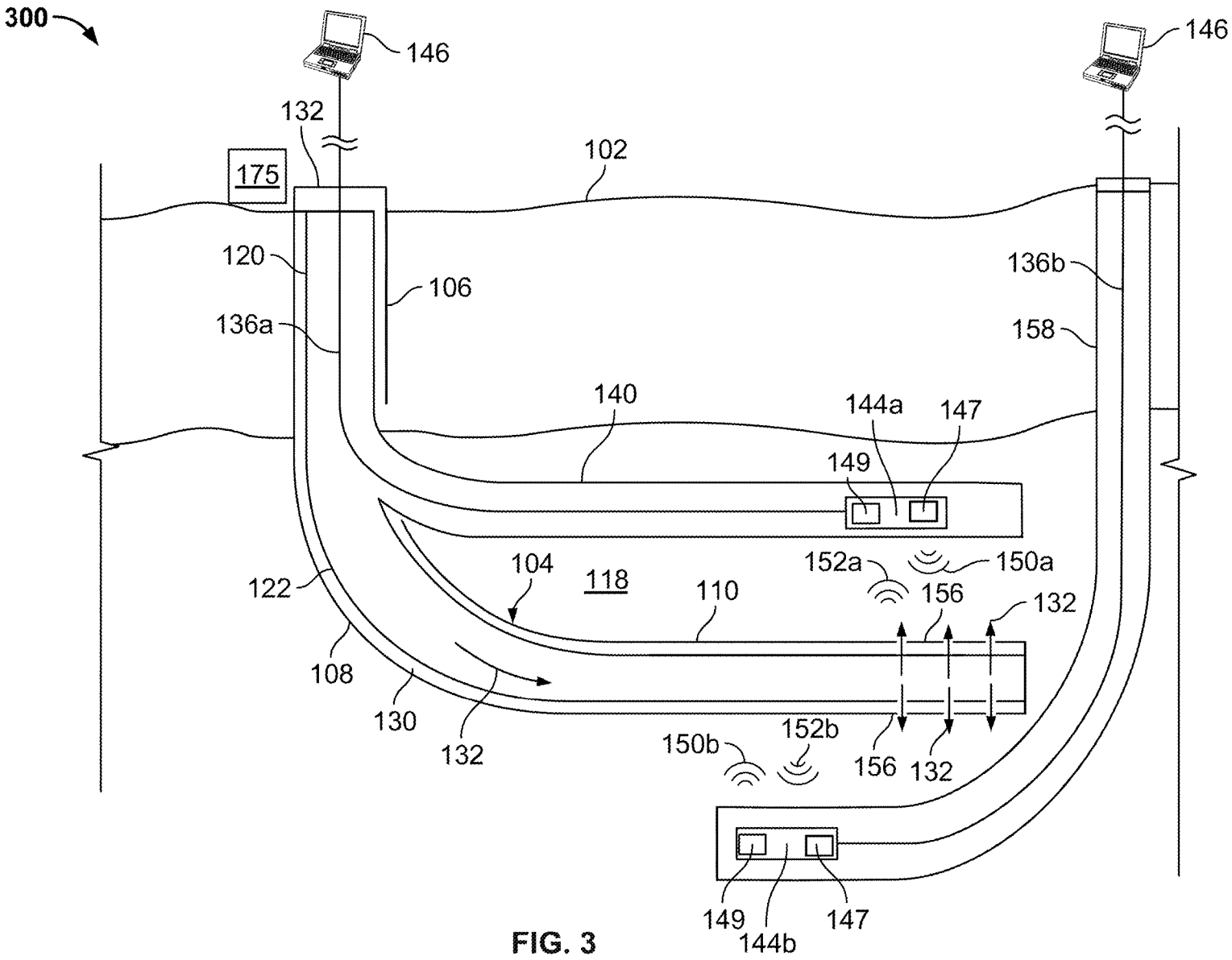

FIGS. 1-3 are schematic illustrations of example implementations of a fluid monitoring system according to the present disclosure. For example, turning to FIG. 1, this figure illustrates an example fluid monitoring system 100. As illustrated, the fluid monitoring system 100 includes an injection wellbore 104 formed (e.g., drilled or otherwise) from a terranean surface 102 (and in some aspects through one or more subterranean formations) into subterranean formation 118. Although the terranean surface 102 is illustrated as a land surface, terranean surface 102 may be a sub-sea or other underwater surface, such as a lake or an ocean floor or other surface under a body of water. Thus, the present disclosure contemplates that the injection wellbore 104 may be formed under a body of water from a drilling location on or proximate the body of water.

The illustrated injection wellbore 104 is a directional wellbore in this example of fluid monitoring system 100. For instance, the injection wellbore 104 includes a substantially vertical portion 106 coupled to a radiused or curved portion 108, which in turn is coupled to a substantially horizontal portion 110. As used in the present disclosure, "substantially" in the context of a wellbore orientation, refers to wellbores that may not be exactly vertical (e.g., exactly perpendicular to the terranean surface 102) or exactly horizontal (e.g., exactly parallel to the terranean surface 102). In other words, those of ordinary skill in the drill arts would recognize that vertical wellbores often undulate offset from a true vertical direction, that they might be drilled at an angle that deviates from true vertical, and horizontal wellbores often undulate offset from a true horizontal direction. Further, the substantially horizontal portion 110, in some aspects, may be a slant wellbore or other directional wellbore that is oriented between exactly vertical and exactly horizontal. Further, the substantially horizontal portion 110, in some aspects, may be a slant wellbore or other directional well bore that is oriented to follow the slant of the formation. As illustrated in this example, the three portions of the injection wellbore 104—the vertical portion 106, the radiused portion 108, and the horizontal portion 110—form a continuous injection wellbore 104 that extends into the Earth.

The illustrated injection wellbore 104 can include a surface casing 120 positioned and set around the injection wellbore 104 from the terranean surface 102 into a particular depth in the Earth. For example, the surface casing 120 may be a relatively large-diameter tubular member (or string of members) set (e.g., cemented) around the injection wellbore 104 in a shallow formation. As used herein, "tubular" may refer to a member that has a circular cross-section, elliptical cross-section, or other shaped cross-section. In some aspects, the surface casing 112 may isolate the injection wellbore 104 from such mobile water, and may also provide a hanging location for other casing strings to be installed in the injection wellbore 104. Further, although not shown, a conductor casing may be set above the surface casing 120 (e.g., between the surface casing 120 and the surface 102) to prevent drilling fluids from escaping.

As illustrated, a production casing 122 is positioned and set within the injection wellbore 104 downhole of the surface casing 120. Although termed a "production" casing, in this example, the casing 122 may or may not have been subject to hydrocarbon production operations. Thus, the casing 122 refers to and includes any form of tubular member that is set (e.g., cemented) in the injection wellbore 104 downhole of the surface casing 120. In some examples of the fluid monitoring system 100, the production casing 122 may begin at an end of the radiused portion 108 and extend throughout the substantially horizontal portion 110. The casing 122 could also extend into the radiused portion 108 and into the vertical portion 106.

As shown, cement 130 is positioned (e.g., pumped) around the casings 120 and 122 in an annulus between the casings 120 and 122 and the injection wellbore 104. The cement 130, for example, may secure the casings 120 and 122 (and any other casings or liners of the injection wellbore 104) through the subterranean formations under the terranean surface 102. In some aspects, the cement 130 may be installed along the entire length of the casings (e.g., casings 120 and 122 and any other casings), or the cement 130 could be used along certain portions of the casings if adequate for the injection wellbore 104. The injection wellbore 104 and associated casings 120 and 122 may be formed with various example dimensions and at various example depths (e.g., true vertical depth, or TVD).

As shown in this example, a fluid pumping system 175 in the fluid monitoring system 100 is positioned to circulate a fluid 132 (such as a hydrocarbon fluid or greenhouse gas fluid) into the injection wellbore 104 from the terranean surface 102. Fluid pumping system 175 can include, for example, one or more pumps, piping, valving, and other fittings sufficient to circulate the fluid 132 into the injection wellbore 104 and to the subterranean formation 118. As shown in FIG. 1, the fluid 132 circulates into the horizontal portion 110 and then into subterranean formation 118 through one or more perforations 156 (or simply from the horizontal portion 110 in the case of an open hole completion). Fluid 132 can be circulated into the subterranean formation 118, for instance, in order for the fluid 132 to be disposed of or stored in the subterranean formation 118.

In this example, the fluid monitoring system 100 includes a monitor wellbore 140 that extends from the vertical portion 106 and lands (in this example) within the subterranean formation 118 into which the injection wellbore 104 is formed. Alternatively, the monitor wellbore 140 can be formed near (but not landing in) the subterranean formation 118 into which the injection wellbore 104 is formed. As shown in this example, a downhole tool 144 is run into the monitor wellbore 140 on a downhole conveyance 136, such as a wireline, slickline, or other form of conveyance.

The downhole tool 144, in this example, comprises a downhole sonic tool 144 (for example, monopole, dipole, quadripole) that includes one or more acoustic (or seismic) energy sources 147 and one or more acoustic (or seismic) energy receivers 149 (such as DAS receivers). Examples of the downhole sonic tool 144 include, for instance, a Compact™ tool by Weatherford, a Sonic Scanner tool by Schlumberger, or a Borehole Sonic Array Tool (BSAT) by Halliburton. Generally, the downhole sonic tool 144 can be operated (for example through the downhole conveyance 136 as a wireline), to emit (by the one or more acoustic energy sources 147 in the tool 144) acoustic energy 150 from the monitor wellbore 140 into the subterranean formation 118. Reflected acoustic energy 152 that reflects from the fluid 132 entrained within the subterranean formation 118 is received at the one or more acoustic energy receivers 149.

As shown in FIG. 1, a fluid monitoring control system 146 is communicably coupled to the downhole tool 144; in this example, through the downhole conveyance 136. In some aspects, the fluid monitoring control system 146 can control (for example, with or without human intervention) operation of the downhole tool 144 to operate the acoustic energy sources 147 through the downhole conveyance 136. Further, the fluid monitoring control system 146 can receive or otherwise store or identify data generated by the downhole tool 144 that represents the reflected acoustic energy 152 received at the one or more acoustic energy receivers 149 in the tool 144.

FIG. 1 shows that the injection wellbore 104 is deeper (for example, at a greater TVD) than the monitor wellbore 140. Further, as shown, the monitor wellbore 140 is a lateral wellbore from the vertical portion 106 (which is also part of the injection wellbore 104). However, in alternative aspects, fluid injection of fluid 132 can be implemented from the lateral wellbore 140 (making it the injection wellbore), while the downhole tool 144 can be run into and operated in the wellbore 104 (and in some aspects, in the horizontal portion 110, making this wellbore the monitor wellbore. Further, although only one injection wellbore and one monitor wellbore are shown in the fluid monitoring system 100, there can be multiple injection wellbores or multiple monitor wellbores, or both, in the fluid monitoring system 100 without departing from the scope of this disclosure.

Turning to FIG. 2, this figure illustrates another example fluid monitoring system 200. Generally, fluid monitoring system 200 is similar to the fluid monitoring system 100 except for in this example, a vertical (or slant) monitor wellbore 142 (or, in other examples, multiple vertical or slant monitor wellbores 142) is formed from the terranean surface 102 to within or near the subterranean formation 118. As shown in this example, the downhole tool 144 can be run into the vertical (or slant) monitor wellbore 142 (which can be cased or open hole) on the downhole conveyance 136 and operated from within the vertical (or slant) monitor wellbore 142 to emit acoustic energy 150 and receive reflected acoustic energy 152 from fluid 132 entrained within the subterranean formation 118.

Turning to FIG. 3, this figure illustrates another example fluid monitoring system 300. Generally, fluid monitoring system 300 is similar to the fluid monitoring system 100 except for in this example, a secondary monitor wellbore 158 (or, in other examples, multiple secondary monitor wellbores 158) is formed from the terranean surface 102 to within or near the subterranean formation 118. In this example, the secondary monitor wellbore 158 (which can be cased or open hole) is formed with a TVD greater than the injection wellbore 104, thereby providing for monitor wellbore 140 that is shallower than the injection wellbore 104 and secondary monitor wellbore 148 that is deeper than the injection wellbore 104. As shown in this example, a downhole tool **144*a* can be run into the monitor wellbore 140 on a downhole conveyance 136*a* and operated from within the monitor wellbore 140 to emit acoustic energy 150 and receive reflected acoustic energy 152 from fluid 132 entrained within the subterranean formation 118. Furthermore, a downhole tool 144*b* can be run into the secondary monitor wellbore 158 on a downhole conveyance 136*b* and operated from within the secondary monitor wellbore 158 to emit acoustic energy 150 and receive reflected acoustic energy 152 from fluid 132 entrained within the subterranean formation 118. Thus, in this example, there can be a blended acquisition (by acoustic energy receivers 149) of reflected acoustic energy 152 from the combination of the downhole tool 144*a* and the downhole tool 144*b***.

The example fluid monitoring systems 100, 200, and 300 can be operated to perform one or more fluid monitoring operations. For example, prior to, during, or subsequent to injection of fluid 132 (by fluid pumping system 175) into the subterranean formation 118 through one or more injection wellbores 104, the illustrated downhole tool(s) can be operated from within the one or more monitor wellbores (for example, 140, 142, and/or 158) to emit acoustic energy 150 from one or more acoustic energy sources 147 into the subterranean formation 118. The acoustic energy 150 can be emitted once or multiple time instances during injection of the fluid 132. The emitted acoustic energy 150 returns to the downhole tool(s) from the subterranean formation 118 and fluid 132 therewithin as reflected acoustic energy 152. Reflected acoustic energy 152 is received by the one or more acoustic energy receivers 149.

Data representing the reflected acoustic energy 152 can be used, for example by fluid monitoring control system 146, to monitor the fluid 132 in the subterranean formation 118. For example, by receiving or identifying multiple data sets of the reflected acoustic energy 152, the fluid monitoring control system 146 can generate one or more subterranean models of the fluid 132 within the subterranean formation 118. In some aspects, the generated models can be used to determine an effectiveness of the injection process. The data can be comprised of full wavefield sonic datasets to create the model (or models) of the subterranean formation, including any movement of the fluid 132 within the subterranean formation 118 over time.

The generated models can also be used to track fluid accumulation within the subterranean formation 118 as well as to predict a distance from the injection wellbore 104 to the one or more monitoring wellbores as a function of depth. As additional or repeated data sets are collected, time and injection rate of the fluid 132 needed to reach another subterranean formation (above or below the formation 118) can be estimated.

In some aspects, the one or more downhole tools can be moved within the monitoring wellbore(s) during or in between emissions of the acoustic energy 150. By moving the downhole tool(s) during the acoustic energy emissions process, lateral changes in the fluid 132 in the formation 118 can be observed or modeled.

In example implementations with multiple monitor wellbores, acoustic or seismic imaging of each of the monitor wellbores can be performed simultaneously in order to enhance the resolution around the target of interest (the subterranean formation 118 and/or injection wellbore 104).

In some aspects, one or more subterranean models generated by the fluid monitoring control system 146 can implement or include coda-wave interferometry, which is processed to locate spatial variation in the sonic velocity related to the propagation of fluid 132 in the subterranean formation 118. The model(s) can also include or utilize full wavefield data, which is acquired on multiple times and processed to locate the temporal variation in the sonic velocity related to the propagation of the fluid 132 in the subterranean formation 118. In some aspects, the models can be generated using Kirchhoff depth migration or Reverse Time migration (acoustic, acoustic VTI, acoustic TTI, acoustic HTI, elastic, elastic VTI, elastic TTI, elastic HTI, visco-acoustic, etc.).

In example implementations with multiple monitoring wellbores, other data can be recorded by the downhole tools. For example, non-seismic measurements such as resistivity and EM can be taken to evaluate the fluid content based on models generated via sonic data.

Figure 4:
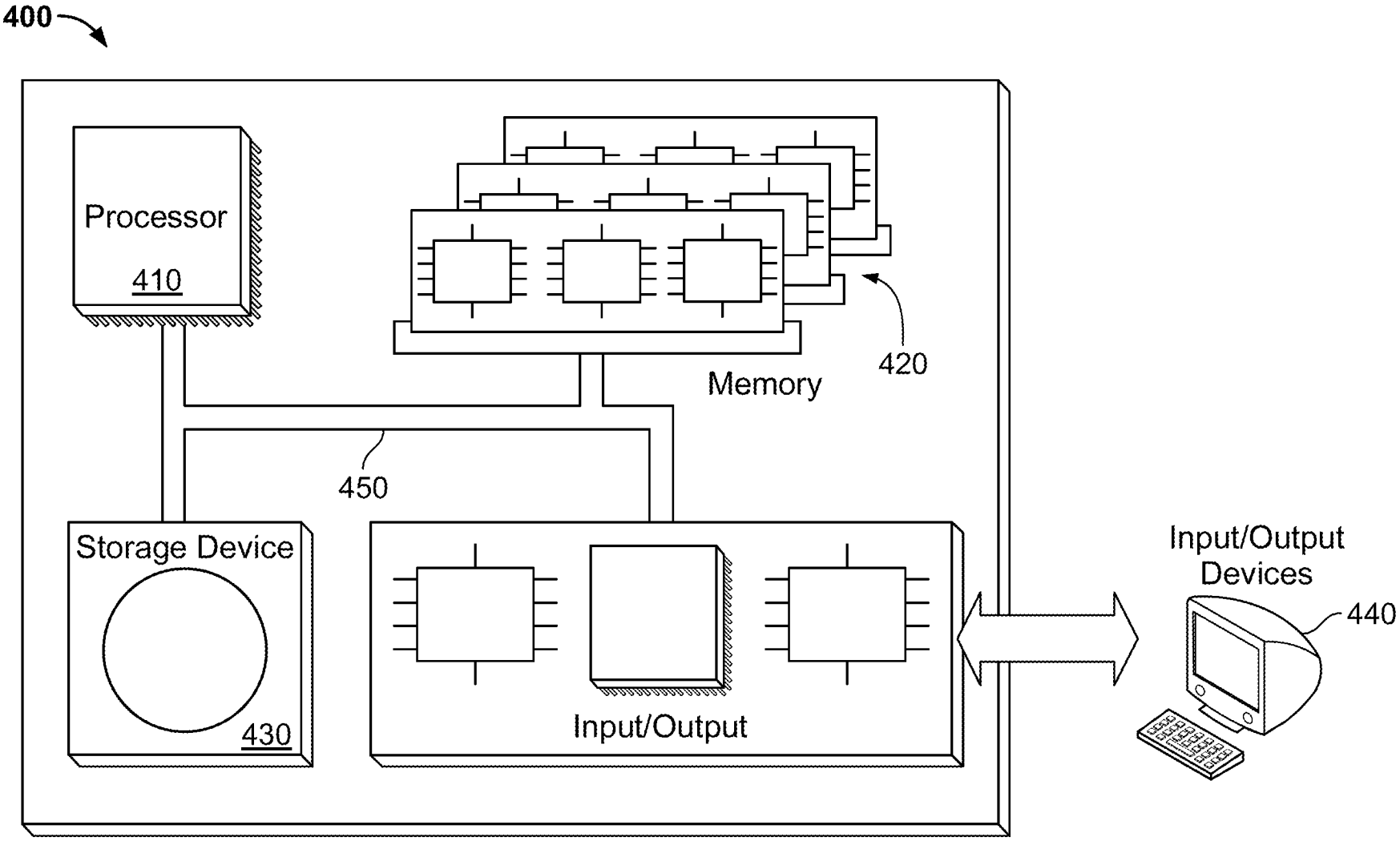
FIG. 4 is a schematic illustration of a controller or control system for a fluid monitoring system according to the present disclosure.

FIG. 4 is a schematic illustration of an example controller 400 (or control system) for a fluid monitoring system. For example, the controller 400 can be used for the operations described previously, for example as or as part of the fluid monitoring control system 146. For example, the controller 400 may be communicably coupled with, or as a part of, a fluid monitoring system as described herein.

The controller 400 is intended to include various forms of digital computers, such as printed circuit boards (PCB), processors, digital circuitry, or otherwise that is part of a vehicle. Additionally, the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 400 includes a processor 410, a memory 420, a storage device 430, and an input/output device 440. Each of the components 410, 420, 430, and 440 are interconnected using a system bus 450. The processor 410 is capable of processing instructions for execution within the controller 400. The processor may be designed using any of a number of architectures. For example, the processor 410 may be a CISC (Complex Instruction Set Computers) processor, a RISC (Reduced Instruction Set Computer) processor, or a MISC (Minimal Instruction Set Computer) processor.

In one implementation, the processor 410 is a single-threaded processor. In another implementation, the processor 410 is a multi-threaded processor. The processor 410 is capable of processing instructions stored in the memory 420 or on the storage device 430 to display graphical information for a user interface on the input/output device 440.

The memory 420 stores information within the controller 400. In one implementation, the memory 420 is a computer-readable medium. In one implementation, the memory 420 is a volatile memory unit. In another implementation, the memory 420 is a non-volatile memory unit.

The storage device 430 is capable of providing mass storage for the controller 400. In one implementation, the storage device 430 is a computer-readable medium. In various different implementations, the storage device 430 may be a floppy disk device, a hard disk device, an optical disk device, a tape device, flash memory, a solid state device (SSD), or a combination thereof.

The input/output device 440 provides input/output operations for the controller 400. In one implementation, the input/output device 440 includes a keyboard and/or pointing device. In another implementation, the input/output device 440 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, solid state drives (SSDs), and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) or LED (light-emitting diode) monitor for displaying information to the user and a keyboard and a pointing device such as a mouse or a trackball by which the user can provide input to the computer. Additionally, such activities can be implemented via touchscreen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A fluid monitoring system, comprising:

at least one injection wellbore formed from a terranean surface into a subterranean formation;

a fluid injection assembly configured to circulate a fluid through the at least one injection wellbore and into the subterranean formation;

at least one monitor wellbore formed from the terranean surface into or near the subterranean formation, the at least one monitor wellbore separated from the at least one injection wellbore by the subterranean formation;

at least one acoustic energy source positioned in the at least one monitor wellbore and configured to emit acoustic energy from the at least one monitor wellbore into the subterranean formation; and at least one acoustic energy receiver positioned in the at least one monitor wellbore and configured to receive acoustic energy reflected from the fluid circulated into the subterranean formation to the at least one acoustic energy receiver.

2. The fluid monitoring system of claim 1, wherein the at least one injection wellbore comprises a directional wellbore that includes a vertical wellbore portion, a curved wellbore portion, and a horizontal wellbore portion.

3. The fluid monitoring system of claim 2, wherein the at least one monitor wellbore comprises a vertical wellbore.

4. The fluid monitoring system of claim 2, wherein the at least one monitor wellbore comprises another directional wellbore that includes the vertical wellbore portion, another curved wellbore portion, and another horizontal wellbore portion.

5. The fluid monitoring system of claim 2, wherein the at least one monitor wellbore comprises a first monitor wellbore and a second monitor wellbore, each of the first and second monitor wellbores formed from the terranean surface into or near the subterranean formation.

6. The fluid monitoring system of claim 5, wherein the at least one acoustic energy source comprises a first acoustic energy source positioned in the first monitor wellbore and a second acoustic waver energy source positioned in the second monitor wellbore; and the at least one acoustic energy receiver comprises a first acoustic energy receiver positioned in the first monitor wellbore and a second acoustic energy receiver positioned in the first monitor wellbore.

7. The fluid monitoring system of claim 5, wherein the first monitor wellbore comprises a first directional wellbore formed from the terranean surface into or near the subterranean formation, and the second monitor wellbore comprises a second directional wellbore formed from the terranean surface into or near the subterranean formation.

8. The fluid monitoring system of claim 7, wherein the second directional wellbore has a total vertical depth greater than a total vertical depth of the first directional wellbore.

9. The fluid monitoring system of claim 1, further comprising at least one downhole tool positionable in the at least one monitor wellbore and including the at least one acoustic energy source and the at least one acoustic energy receiver.

10. The fluid monitoring system of claim 9, wherein the at least one downhole tool comprises:

a first downhole tool positionable in a first monitor wellbore of the at least one monitor wellbore, the first downhole tool comprising a first acoustic energy source and a first acoustic energy receiver; and a second downhole tool positionable in a second monitor wellbore of the at least one monitor wellbore, the second downhole tool comprising a second acoustic energy source and a second acoustic energy receiver.

11. The fluid monitoring system of claim 9, wherein the at least one downhole tool is configured to run into the at least one monitor wellbore on a downhole conveyance.

12. The fluid monitoring system of claim 11, wherein the downhole conveyance comprises a wireline.

13. The fluid monitoring system of claim 12, wherein the at least one downhole tool comprises a wireline sonic tool.

14. The fluid monitoring system of claim 1, wherein the at least one acoustic energy source positioned in the at least one monitor wellbore is configured to emit acoustic energy from the at least one monitor wellbore into the subterranean formation at a plurality of time instances during injection of the fluid from the at least one injection wellbore into the subterranean formation; and the at least one acoustic energy receiver positioned in the at least one monitor wellbore is configured to receive acoustic energy reflected from the fluid circulated into the subterranean formation to the at least one acoustic energy receiver at another plurality of time instances during injection of the fluid from the at least one injection wellbore into the subterranean formation.

15. The fluid monitoring system of claim 14, further comprising a control system communicably coupled to the at least one acoustic energy receiver and configured to determine movement of the fluid in the subterranean formation based on the received acoustic energy reflected from the fluid circulated into the subterranean formation to the at least one acoustic energy receiver at the another plurality of time instances.

16. The fluid monitoring system of claim 1, further comprising a control system communicably coupled to the at least one acoustic energy receiver and configured to determine movement of the fluid in the subterranean formation based on the received acoustic energy reflected from the fluid circulated into the subterranean formation to the at least one acoustic energy receiver.

17. A method of monitoring a fluid in a subterranean formation, comprising:

operating a fluid injection assembly configured to circulate a fluid through at least one injection wellbore into a subterranean formation, the at least one injection wellbore formed from a terranean surface into the subterranean formation;

operating at least one acoustic energy source positioned in at least one monitor wellbore to emit acoustic energy from the at least one monitor wellbore into the subterranean formation, the at least one monitor wellbore formed from the terranean surface into or near the subterranean formation separated from the at least one injection wellbore by the subterranean formation; and operating at least one acoustic energy receiver positioned in the at least one monitor wellbore to receive acoustic energy reflected from the fluid circulated into the subterranean formation.

18. The method of claim 17, wherein the at least one injection wellbore comprises a directional wellbore that includes a vertical wellbore portion, a curved wellbore portion, and a horizontal wellbore portion.

19. The method of claim 18, wherein the at least one monitor wellbore comprises a vertical wellbore.

20. The method of claim 18, wherein the at least one monitor wellbore comprises another directional wellbore that includes the vertical wellbore portion, another curved wellbore portion, and another horizontal wellbore portion.

21. The method of claim 18, wherein the at least one monitor wellbore comprises a first monitor wellbore and a second monitor wellbore, each of the first and second monitor wellbores formed from the terranean surface into or near the subterranean formation.

22. The method of claim 21, wherein operating at least one acoustic energy source comprises operating a first acoustic energy source positioned in the first monitor wellbore and operating a second acoustic waver energy source positioned in the second monitor wellbore; and operating at least one acoustic energy receiver comprises operating a first acoustic energy receiver positioned in the first monitor wellbore and operating a second acoustic energy receiver positioned in the first monitor wellbore.

23. The method of claim 21, wherein the first monitor wellbore comprises a first directional wellbore formed from the terranean surface into or near the subterranean formation, and the second monitor wellbore comprises a second directional wellbore formed from the terranean surface into or near the subterranean formation.

24. The method of claim 23, wherein the second directional wellbore has a total vertical depth greater than a total vertical depth of the first directional wellbore.

25. The method of claim 17, further comprising operating at least one downhole tool in the at least one monitor wellbore that comprises the at least one acoustic energy source and the at least one acoustic energy receiver.

26. The method of claim 25, wherein operating the at least one downhole tool comprises:

operating a first downhole tool in a first monitor wellbore of the at least one monitor wellbore to activate a first acoustic energy source and a first acoustic energy receiver; and operating a second downhole tool in a second monitor wellbore of the at least one monitor wellbore to activate a second acoustic energy source and a second acoustic energy receiver.

27. The method of claim 25, comprising running the at least one downhole tool into the at least one monitor wellbore on a downhole conveyance.

28. The method of claim 27, wherein the downhole conveyance comprises a wireline.

29. The method of claim 28, wherein the at least one downhole tool comprises a wireline sonic tool.

30. The method of claim 17, comprising operating the at least one acoustic energy source positioned in the at least one monitor wellbore to emit acoustic energy from the at least one monitor wellbore into the subterranean formation at a plurality of time instances during injection of the fluid from the at least one injection wellbore into the subterranean formation; and operating the at least one acoustic energy receiver positioned in the at least one monitor wellbore to receive acoustic energy reflected from the fluid circulated into the subterranean formation to the at least one acoustic energy receiver at another plurality of time instances during injection of the fluid from the at least one injection wellbore into the subterranean formation.

31. The method of claim 30, comprising determining movement of the fluid in the subterranean formation based on the received acoustic energy reflected from the fluid circulated into the subterranean formation to the at least one acoustic energy receiver at the another plurality of time instances.

32. The method of claim 17, comprising determining movement of the fluid in the subterranean formation based on the received acoustic energy reflected from the fluid circulated into the subterranean formation to the at least one acoustic energy receiver.

* * * * *